US009049886B2

(12) United States Patent
Zimmermann

(10) Patent No.: US 9,049,886 B2
(45) Date of Patent: Jun. 9, 2015

(54) METHODS AND APPARATUS FOR THE SELECTIVE REMOVAL OF CONSTITUENTS FROM AQUEOUS TOBACCO EXTRACTS

(75) Inventor: Stephen G. Zimmermann, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 876 days.

(21) Appl. No.: 11/698,146

(22) Filed: Jan. 26, 2007

(65) Prior Publication Data

US 2008/0178894 A1 Jul. 31, 2008

(51) Int. Cl.
*A24B 15/26* (2006.01)
*A24B 15/24* (2006.01)

(52) U.S. Cl.
CPC ..... *A24B 15/24* (2013.01); *A24B 15/245* (2013.01)

(58) Field of Classification Search
None
See application file for complete search history.

(56) References Cited

U.S. PATENT DOCUMENTS

| | | | |
|---|---|---|---|
| 1,016,844 | A | 2/1912 | Moonelis |
| 3,386,449 | A | 6/1968 | Hind et al. |
| 3,561,451 | A | 2/1971 | Jacin et al. |
| 3,616,801 | A | 11/1971 | Hind et al. |
| 3,760,815 | A | 9/1973 | Deszyck |
| 3,840,026 | A | 10/1974 | Rosen |
| 3,847,163 | A | 11/1974 | Molyneux |
| 3,847,164 | A | 11/1974 | Mattina et al. |
| 4,131,117 | A | 12/1978 | Kite et al. |
| 4,144,895 | A | 3/1979 | Fiore |
| 4,153,063 | A | 5/1979 | Roselius et al. |
| 4,200,113 | A | 4/1980 | Schmidt |
| 4,244,381 | A | 1/1981 | Lendvay |
| 4,253,929 | A | 3/1981 | Keritsis |
| 4,301,817 | A | 11/1981 | Keritsis |
| 4,302,308 | A | 11/1981 | Keritsis |
| 4,341,228 | A | 7/1982 | Keritsis et al. |
| 4,364,401 | A | 12/1982 | Keritsis |
| 4,566,469 | A | 1/1986 | Semp et al. |
| 4,636,288 | A | 1/1987 | Vaughan |
| 4,674,519 | A | 6/1987 | Keritsis et al. |
| 4,700,723 | A | 10/1987 | Yoshikawa et al. |
| 5,079,274 | A | 1/1992 | Schneider et al. |
| 5,094,732 | A | 3/1992 | Oldani et al. |
| 5,099,862 | A | 3/1992 | White et al. |
| 5,119,835 | A | 6/1992 | Heemann et al. |
| 5,121,757 | A | 6/1992 | White et al. |
| 5,148,821 | A | 9/1992 | Best et al. |
| 5,301,694 | A | 4/1994 | Raymond et al. |
| 5,339,838 | A | 8/1994 | Young et al. |
| 5,435,941 | A | 7/1995 | Von Fraunhofer |
| 5,460,725 | A | 10/1995 | Stringfield |
| 5,497,792 | A | 3/1996 | Prasad et al. |
| 5,601,097 | A | 2/1997 | De Grandpré et al. |
| 5,724,998 | A | 3/1998 | Gellatly et al. |
| 5,810,020 | A | 9/1998 | Northway et al. |
| 6,298,859 | B1 | 10/2001 | Kierulff et al. |
| 2002/0134394 | A1 | 9/2002 | Baskevitch et al. |
| 2002/0185142 | A1 | 12/2002 | Han |
| 2004/0025891 | A1 * | 2/2004 | McAdam et al. ..... 131/297 |
| 2004/0112394 | A1 | 6/2004 | Krukonis et al. |
| 2005/0241657 | A1 | 11/2005 | Mua et al. |

FOREIGN PATENT DOCUMENTS

| | | | |
|---|---|---|---|
| CH | 387 518 | | 1/1965 |
| EP | 1782702 | A1 | 5/2007 |
| GB | 1 222 060 | | 2/1971 |
| WO | WO 03/041519 | | 5/2003 |
| WO | WO2005/122803 | A | 12/2005 |
| WO | WO2005122803 | * | 12/2005 |
| WO | WO2007/032433 | A | 3/2007 |

OTHER PUBLICATIONS http://www.dow.com/liquidseps/prod/dx_opt_I493.htm.*
http://web.archive.org/web/*/http://www.dow.com/liquidseps/prod/dx_opt_I493.htm.*
Dowex Marathon A2.*
Dowex Ion Exchange.*
International Search Report and Written Opinion dated Jun. 19, 2009 for PCT/IB2008/001021.
International Preliminary Report on Patentability dated Jun. 14, 2007 for PCT/IB2005/003972.
International Search Report mailed Mar. 20, 2006 in connection with PCT/IB2005/003972, together with the Written Opinion of the International Searching Authority.
Thomas E. McGrath et al., "Low Temperature Mechanism for the Formation of Polycyclic Aromatic Hydrocarbons from the Pyrolysis of Cellulose," Journal of Analytical and Applied Pyrolysis, vol. 66, 2003, pp. 51-70.
W. S. Schlotzhauer et al., "Pyrolysis of Tobacco Extracts," The Chemistry of Tobacco and Tobacco Smoke, Plenum Publishing Corporation, 1995, pp. 65-76.
International Preliminary Report on Patentability issued Feb. 24, 2010 for PCT/IB2008/001021.
Partial Translation of Office Action issued Oct. 24, 2012 for Japanese Appln. No. 2009-546839.
"A New Portfolio of Cost-Effective Solutions for Trace Contaminant Removal" The Dow Chemical Company, May 2006.
"Ion Exchange Resins", The Dow Chemical Company, Jun. 15, 2002, pp. 1-10.
Translation of Office Action issued Feb. 7, 2013 for Taiwanese Appln. No. 097101978.
"Brominated Polystyrene Resins Sepabeads SP207" XP002506854, Retrieved from the Internet: URL:http://www.sorbtech.com/Chromatography/PolymericResins/BrominatedStyrenic/Tabid/558/Default.aspx, 2009.
Partial International Search Report mailed Dec. 23, 2008 for PCT/IB2008/001021.

* cited by examiner

*Primary Examiner* — Richard Crispino
*Assistant Examiner* — Phu Nguyen
(74) *Attorney, Agent, or Firm* — Buchanan Ingersoll & Rooney PC

(57) ABSTRACT

Methods for the selective removal of specific constituents of tobacco extract include contacting an extract with a nitrosamine selective adsorption agent, a metal selective adsorption agent and/or a nitrate selective adsorption agent. Preferred characteristics of such agents are identified.

24 Claims, No Drawings

METHODS AND APPARATUS FOR THE SELECTIVE REMOVAL OF CONSTITUENTS FROM AQUEOUS TOBACCO EXTRACTS

BACKGROUND

Various methods related to making reconstituted tobacco, by using an aqueous tobacco extract have been disclosed. As examples, see U.S. Pat. Nos. 1,016,844; 3,760,815; 3,847,163; 3,386,449 and 4,674,519. Various methods of adjusting the contents of tobacco plant extracts have also been disclosed. For example U.S. Pat. No. 3,616,801 describes contacting tobacco plant parts with water to obtain an aqueous tobacco extract, treating said extract to adjust its content of certain metallic ions and recombining the treated aqueous tobacco extract with the extracted tobacco parts. U.S. Pat. No. 5,810,020 describes a process for denitrifying tobacco material wherein an organic solvent comprising a crown ether is used to extract certain constituents from an aqueous solution of soluble tobacco components. U.S. Pat. Nos. 4,153,063; 5,119,835 and 5,497,792 describe the use of supercritical solvents to remove alkaloids such as nicotine from tobacco.

SUMMARY

Disclosed are improved methods and apparatus for the selective separation of specific constituents from tobacco plant extracts. This application describes, among other things, methods and apparatus for economical and selective removal of specific constituents from aqueous tobacco extracts. For example, a method of selectively reducing the amount of tobacco specific nitrosamines (TSNAs) from an aqueous tobacco extract comprises contacting the extract with a TSNA selective adsorption agent. As used herein, a TSNA selective adsorption agent is an agent that selectively adsorbs TSNA compounds to a substantially greater extent than other constituents of aqueous tobacco extract such as alkaloids. The TSNA selective adsorption agent preferably has a TSNA selectivity index of greater than 2, more preferably greater than 4, and most preferably greater than about 8.

The TSNA selective adsorption agent can be a porous resin polymer. The porous resin polymer can be provided in bead form. The resin can be a macroreticular resin. Preferably, the resin is a styrene-divinylbezene copolymer resin that has been cross-linked in the swollen state. Preferred varieties of such a resin have a pore structure that encompasses both macropores and micropores, i.e., it has relatively larger cavities and channels on the order of 100 s of Angstroms in diameter that branch into smaller cavities. These smaller pores preferably have an average diameter of less than 100 Angstroms, for example about 30-60 Angstroms, or about 40-50 Angstroms, such as about 46 Angstroms.

Further, a method of selectively reducing the amount of specific metal ions (e.g., cadmium) from an aqueous tobacco extract comprises contacting the extract with a metal selective adsorption agent. A metal selective adsorption agent can be a functionalized resin, for example, in bead form. The resin can be a polymer resin such as a styrene-divinylbenzene resin that has been cross-linked in the swollen state and with metal binding functional groups incorporated in the resin. The functionalized resin can contain metal binding functional groups such as a chelating moiety. A preferred type of chelating moiety is an iminodiacetate moiety.

The above methods can also include steps of making an aqueous tobacco extract such as chopping tobacco plant parts, collecting tobacco plant parts, and contacting the tobacco plant parts with an aqueous solution, such as water. The above methods can also include a step of concentrating the aqueous tobacco extract. The above method steps can be combined as part of a processing method which includes steps for the selective removal of a plurality of constituents of an aqueous tobacco extract. Further, the methods can be combined such that the steps of contacting the concentrated tobacco extract with a plurality of selective adsorption agents may be combined in a single step of contacting the tobacco extract with a mixed bed of selective adsorption agents, a series of selective agents distributed along the length of a resin contacting vessel, or in a series of connected vessels each containing a selective adsorption agent.

Alternatively, aqueous tobacco extract can be contacted with one or more selective adsorption agents in one or more batch process steps in which extract and agent(s) are contacted in a vessel such that the agent does not form a bed. For example, agent and extract can be contacted in a vessel and subjected to stirring or agitation sufficient to keep the agent suspended but preferably not so vigorous as to cause foaming. Agent(s) and extract are then separated by any appropriate method such as filtration or allowing the agent to settle, which can be accelerated by centrifugation.

Alternatively, a counter-current arrangement can be utilized in the contacting step. In such an arrangement, aqueous tobacco extract and selective adsorption agent(s) are introduced from opposing portions of a vessel. For example, aqueous tobacco extract can be introduced to an upper portion of a vessel while selective adsorption agent can be continuously introduced in a lower portion of the vessel such that the flow rate of the agent achieves plug flow through the extract and is collected from at or near the top of the vessel and extract is collected from at or near the bottom of the vessel. Alternatively, aqueous tobacco extract can be introduced to a lower portion of a vessel while a selective adsorption agent can be introduced in an upper portion of the vessel and the upflow rate of the aqueous tobacco extract can be maintained such that the selective adsorption agent flows downwardly through the extract so that agent can be collected from at or near the bottom portion of the vessel while extract is collected from at or near the top portion of the vessel.

It can be advantageous to pass extract simultaneously through a plurality of contacting vessels, which can be connected in series or in parallel. In such a system, it can also be advantageous to maintain a number of out-of-service vessels, which can be approximately equal to the number of in-service vessels, and which can be in a standby or regenerating mode.

DETAILED DESCRIPTION OF PREFERRED EMBODIMENTS

In preparing smoking materials from plants such as tobacco, reconstituted materials can be made by separating a soluble extract from the insoluble portion of the plant. The soluble and insoluble portions can be processed separately and subsequently can be recombined in a finished product. Such reconstituted material can used in various portions of a smoking article and can be blended with natural tobacco and/or other materials. In processing the soluble portion, it can be desirable to separate specific constituents, for example, for use in other applications or to change the characteristics of the reconstituted product. See, for example, commonly-owned U.S. Pat. Nos. 3,616,801 and 5,339,838, which are incorporated herein by reference in their entirety.

An aqueous extract of tobacco plant can be created in any suitable manner recognized in the art. For example, by a method comprising contacting tobacco plant material with water, such as filtered water, distilled water, de-ionized water, common tap water, or an aqueous solution. Additives including acids, bases, salts, buffers, and/or water miscible solvents such as alcohols can be added to the water to modify the extraction of soluble components of tobacco.

Tobacco is usually dried or cured prior to processing. The tobacco is usually cut or chopped to a small size before preparing an extract. Alternatively, or in addition, small pieces and dust of tobacco plant material, which may be produced in the processing of tobacco, can be used in making an aqueous tobacco extract. The tobacco material is contacted with water or an aqueous solution in a container for a period of time during which the mixture can be stirred or otherwise agitated such as by rotating the container. The temperature and pressure of the mixture can be controlled to optimize the extraction process. For example, the temperature of the water or aqueous solution can be greater than about 100° F., such as about 110° F. to about 140° F., but preferably less than or equal to the boiling temperature of the solution. A preferred temperature is about 115-125° F., e.g., about 120° F. Where an elevated temperature solution is desired, the mixture can be heated during the extraction period, or the solution can be heated prior to contacting the plant material. If desired, the extract can be maintained at an elevated temperature during extraction and/or processing.

The liquid aqueous extract, including the soluble portion of the tobacco, can be separated from the insoluble fractions of the mixture by any appropriate method such as decanting, filtration or centrifugation. For example, the liquid and solid fractions can be separated by decanting the liquid extract after the insoluble portion has been allowed to settle, which may be aided by spinning the mixture such as in a drum, by pressing the mixture, by centrifugation such as in a bucket-type or basket-type centrifuge, by a combination or sequence of such steps and the like. A preferred type of centrifuge for the separation of the liquid extract from insoluble tobacco parts includes a basket-type centrifuge such as manufactured by Alfa-Laval. After separation, but before concentration of the extract, the extract can be referred to as pre-concentration extract.

In the methods described herein, the aqueous extract is preferably concentrated. The amount of soluble tobacco constituents in an aqueous extract prior to concentration can be affected by various factors, for example the ratio of aqueous solution to tobacco material in the extraction, the relative portions of leaf and stem parts, time, temperature, pressure, and other conditions of extraction. Concentration of the extract can be accomplished by any suitable method; examples include evaporation and reverse osmosis. Preferably, the extract can be economically concentrated by evaporation of the aqueous solvent. Evaporation can be accelerated by exposing the extract to a lowered pressure and/or increased temperature and by apparatus that increases the exposed surface area of the solvent such as a rotary vessel.

Typically, the extract is maintained at an elevated temperature, such as about 110° F. to 140° F., preferably about 120° F. The characteristics of aqueous tobacco extract can cause an increase in the extract viscosity at higher temperatures so that lower temperatures may improve extract flow processing and adsorption capacity. Constantly stirring or otherwise mixing the extract such as in a vessel on a rotary apparatus may be advantageous. Such stirring is preferably sufficient to prevent formation of a gel in the extract and is preferably not so vigorous as to cause the extract to foam.

The degree of concentration in an extract can be measured by a variety of methods such as specific gravity and refractive index. For use in the present methods, the extract can preferably be concentrated by a factor of about 1.5×, 2× or 3×-5×, for example the extract may be concentrated to a density of about 1.2 to 1.35 g/ml at about 110° to 140° F., for example about 1.28 g/ml.

Selective Removal of Tobacco Specific Nitrosamines (TSNAs) from Aqueous Tobacco Extract Preferred properties of TSNA selective adsorption agents that are effective at selectively removing TSNAs from aqueous tobacco extracts have been identified. As used herein, TSNAs include the compounds 4-(methylnitrosamino)-1-(3-pyridyl)-1-butanone (NNK) N'-nitrosonornicotine (NNN), N'-nitrosoanabasine (NAB), and N'-nitrosoanatabine (NAT). Thus, for example, a method of selectively reducing the amount of one or more of these TSNAs from an aqueous tobacco extract can comprise contacting the extract with a TSNA selective adsorption agent. While non-specific adsorbents such as activated carbon can remove organic compounds such as TSNAs from an aqueous solution, adsorbents having a combination of preferred properties have been found to be surprisingly selective and effective.

Preferred TSNA selective adsorption agents include beads of highly cross-linked non-ionic copolymer of styrene or alkylstyrene and divinyl benzene and/or trivinyl benzene copolymer resins. An agent comprising beads of haloalkylated styrene-divinylbenze resin, post-cross linked in a swollen state using a Friedel-Crafts catalyst is preferred. Such resins are described in detail in U.S. Pat. No. 5,079,274, and references cited therein, which are incorporated by reference in their entirety.

A TSNA selective adsorption agent can be a non-ionic styrene-divinyl benzene macroporous or macroreticular resin. A macroreticular resin has relatively larger pores, on the order of hundreds of Angstroms, which branch into smaller pores and channels, the smaller pores having diameters on the order of tens of Angstroms. Thus, a TSNA selective adsorption agent preferably has a high internal surface area comprising a broad distribution of pore sizes. A preferred TSNA selective adsorption agent can be characterized by a pore size less than about 100 Å, or less than about 50 Å (e.g., about 46 Å). The internal surface area of the TSNA selective adsorption agent can range from about 300 $m^2/g$ to more preferably at least about 1000 $m^2/g$ or greater, most preferably about 1100 $m^2/g$. A total porosity (particle specific pore volume) of about 1.15 $cm^3/g$ or greater is also preferred. A preferred TSNA selective adsorption agent resin has a particle size from about 20-50 mesh and a crush strength of greater than about 500 (g/bead) indicating a highly crosslinked resin.

A preferred TSNA selective adsorption agent comprising styrene-divinyl benzene resin can have a solid density of at least about 1.2 $g/cm^3$, e.g., about 1.24 $g/cm^3$, a bulk density of at least about 0.3 $g/cm^3$, e.g., about 0.35 $g/cm^3$, and a particle density of about 0.50 $g/cm^3$. Such a resin can have a void fraction of about 0.7, e.g., 0.71, with a bulk void fraction of about 0.3, e.g., 0.31 and a particle void fraction of about 0.6, e.g., 0.59. The particle specific pore volume of such a resin can be at least about 1.1 $cm^3/g$, e.g., about 1.17 $cm^3/g$. The particle size is preferably such that the Sauter average diameter can be about 0.7 mm while the number average diameter can be about 0.65 mm and greater than about 70% of the particles can have a diameter between 0.5 and 0.8 mm.

A preferred example of a resin having the preferred properties of a TSNA selective adsorption agent is Dowex™ Optipore™ L493, (also denoted XUS-43493 by the manufacturer, and denoted V493 when prepared for gas phase applications) manufactured by the Dow Chemical Corporation. Purolite™ MN-200 is similar to Dowex™ Optipore™ L493 in some ways and is another example of an acceptable TSNA selective adsorption agent. As a further example, an acrylic ester polymer resin capable of removing TSNA compounds from aqueous tobacco extract is Rohm and Haas XAD-7. Among the exemplary polymer resins, a resin having the characteristics of Dowex™ Optipore™ L493 is preferred over Rohm and Haas XAD-7 for the selective removal of TSNAs. In consideration of the foregoing, additional preferred properties of a TSNA selective adsorption agent can be determined by examining the physical characteristics of these products.

Without intending to be bound by theory, the mechanism by which reduction of TSNA's takes place is believed to be by hydrophobic interaction coupled with molecular sizing. Both the chemical composition of the adsorbent and the structural characteristics are believed to contribute to the effectiveness and selectivity. Thus, a TSNA selective adsorption agent is preferably non-ionic and comprises pores that are size selective for TSNA molecules. The foregoing preferred characteristics and commercial products are illustrative and not limiting or exhaustive. A TSNA selective agent need not be one of the examples or have every preferred characteristic. However, preferred TSNA selective adsorption agents for use in the present methods will generally have a plurality of characteristics that are similar to the characteristics of the exemplary preferred agents.

The characteristics of the extract contacted with an adsorption agent can have an effect on adsorption of selected constituents. For example, increasing the concentration of TSNAs increases the adsorption capacity of TSNA selective adsorption agents. Higher temperatures decrease the adsorption capacity of TSNA selective adsorption agents. However, the viscosity of a concentrated tobacco extract can be strongly affected by temperature, and viscosity can affect adsorption rates. Simply as a guide, a temperature of about 120° F. may be preferred, or may serve as a starting point for optimization. An optimal temperature can be determined by the skilled practitioner depending on conditions of the extract and arrangement of the apparatus to balance requirements of maintaining an appropriate viscosity for processing while providing for adsorption capacity.

The pH of the extract can influence the selectivity of TSNA selective adsorption agents. Higher pH generally favors adsorption of organic bases such as amines. Lower pH favors generally adsorption of organic acids such as phenols. A pH range of about 5 to 7, e.g. about 5.7 to 6.1 is typically preferred.

A TSNA selective adsorption agent is defined as an agent that effectively removes TSNA compounds from a tobacco extract, and removes TSNA compounds to a greater extent than it removes other compounds. For example, a TSNA selective adsorption agent preferably extracts TSNAs to a greater extent than other organic components present in aqueous tobacco extract. Exemplary compounds against which selectivity in tobacco extract can be measured are alkaloids, reducing sugars, and soluble ammonia.

A measure of the effectiveness of a material at removing TSNA from aqueous tobacco extract can by determined by a straightforward measurement of the reduction of TSNA compounds using a standardized amount of adsorbent under standardized conditions. For example, the concentration of TSNA compounds and other compounds can be determined in a sample of untreated concentrated aqueous tobacco extract using any recognized quantitative procedure. To measure adsorptivity, a sample (35 ml) of concentrated extract (e.g., at about 1.25 g/cm$^3$) is allowed to come to equilibrium at a temperature that is consistent with the processing of tobacco extract, such as about 110° F. to 140° F., in the presence of 1 g of adsorbent material under conditions of constant stirring or agitation sufficient to keep the adsorbent in suspension such as by placing the extract and adsorbent material in a vial on a rotary plate. The concentration of total TSNA compounds is compared for treated and untreated extract. A TSNA adsorptivity index on a scale of 0 to 100 can be defined by taking the percentage of total TSNA compounds removed from 35 ml of concentrated aqueous tobacco extract by 1 g of agent. A TSNA selective adsorption agent for use in the present methods will preferably have an adsorptivity index greater than about 50. TSNA selective adsorption agents with adsorptivity indices of greater than about 70 are preferred, and agents with indices of about 80 or greater are most preferred.

A selectivity index for TSNA selective agents can be defined using a procedure as follows. The level of total TSNA compounds and the level of alkaloid compounds is determined in a sample of concentrated aqueous tobacco extract. A sample of the concentrated aqueous tobacco extract (35 ml) is contacted with an amount of the agent (1 g) at a temperature that is consistent with the processing of such extract (for example about 110° F. to about 140° F.) with constant agitation. The mixture is allowed to come to equilibrium. The agent is separated from the concentrated aqueous tobacco extract, and the level of TSNA compounds and the level of alkaloid compounds is again determined in the concentrated aqueous tobacco extract. The TSNA selectivity index is defined as the percentage reduction in the level of all TSNA compounds in 35 ml of concentrated aqueous tobacco extract by 1 g of agent at 110° F. divided by the percent reduction in alkaloids. As an illustration, an agent that reduces the level of TSNA by 80% and the level of alkaloids by 10% has a TSNA selectivity index of 8. A TSNA selective adsorption agent according to the usage herein preferably has a TSNA selectivity index of at least about 2, preferably greater than about 4 and most preferably at least about 8 (e.g., greater than 20, 30, 40, 50, or 60±5).

In this regard, a TSNA selective agent with the characteristics of Dowex™ Optipore™ L493 (or V493) resin has been found to have substantially greater combined effectiveness and selectivity for TSNAs than alternative resins such as Rohm and Haas XAD-7 or general purpose adsorbents. Comparative average characteristics of these resin particles are summarized in Table 1.

TABLE 1

| Resin Product | Resin Type | Means Surface Area (m$^2$) | Mean Pore Diameter (A) | Mesh Size |
|---|---|---|---|---|
| Optipore ™ L493 | Styrene - DVB | 1100 | 46 | 20–50 |
| XAD-7 | Acrylic ester | 450 | 90 | 20–60 |

Selective Removal of Cadmium (Cd), Mercury (Hg), Nickel (Ni), Lead (Pb) and Other Soluble Metal Ions from Aqueous Tobacco Extract A method of selectively reducing the amount of metal ions, such as cadmium, from an aqueous tobacco extract can comprise contacting the extract with a metal selective adsorption agent. Properties of metal selective adsorption agents that are effective at selectively removing soluble metal ions from aqueous tobacco extracts have been identified. It has been discovered that a surprising combination of effectiveness and selectivity for the removal of metal ions from an aqueous tobacco extract can be achieved by the use of weak acid cation exchange resins having a combination of properties as follows.

Preferred resins include macroporous or macroreticular styrene-divinyl benzene resins with metal selective chelating functional groups. Suitable resins have a preferred mesh screen of about 14-52 or about 16-50 mesh. The particle size is preferably such that the average Sauter diameter is about 0.44 mm and the number average is about 0.42 mm with about 70% or more of the particles having diameters between 0.35 mm and 0.5 mm.

Preferably, the resin has an average solid density of about 1.4 g/cm$^3$, e.g., 1.43 g/cm$^3$ in methanol, an average bulk density in air of about 0.5 g/cm$^3$, e.g., about 0.47 g/cm$^3$, and an average particle density of about 0.6 g/cm$^3$, e.g., about 0.64 g/cm$^3$. The overall void fraction is preferably about 0.7, e.g., 0.67, with a bulk void fraction of about 0.25, e.g., 0.27 and a particle void fraction of about 0.55. Thus, the particle specific void volume is preferably about 0.85 cm$^3$/g. Preferred resins have an exchange capacity of at least about 1.1 eq/l, more preferably a capacity of at least about 1.35 eq/l. Advantageously, the resin is functionalized with a chelating moiety.

A chelating moiety is generally a functional chemical group that presents metal binding atoms, such as an oxygen or nitrogen atoms, in a molecular geometry more or less adaptable to interact with the atomic orbitals of a metal ion. When the positions of the metal binding atoms most nearly correspond to the geometry of the valence orbitals of a particular metal atom, specificity and affinity will be optimized. An iminodiacetic acid group is a preferred chelating moiety, because of its selective metal binding properties. Additional examples of chelating moieties include nitrilotriacetic acid (NTA) and ethylenediamine tetra-acetic acid, which can also be incorporated into a resin.

An example of a preferred metal selective adsorption agent includes Amberlite™ IRC-748, manufactured by Rohm and Haas. Examples of alternative metal selective adsorption agents that are macroporous styrene-divinyl benzene resins having iminodiacetate functional groups are Purolite™-930, manufactured by The Purolite Company, and Dowex™ IDA-1, manufactured by the Dow Chemical Company. Further examples include Chelex 20, which is marketed by Bio-Rad, and Lewatit TP 207 and TP 208, manufactured by Sybron™, a Bayer™ Company. Another alternative agent for the selective removal of certain metals from aqueous tobacco extract includes a styrene-divinyl benzene resin comprising aminophosphonic functional groups (—$NHCH_2PO_3$). An example of such a resin is Dowex™ IPA-1, manufactured by the Dow Chemical Company.

One of skill in the art will recognize that the above-identified preferred characteristics of a metal selective adsorption agent and the foregoing commercial product examples are illustrative and not limiting or exhaustive. Any adsorbent material possessing a combination of characteristics illustrated by these examples, i.e., a porous material comprising a metal selective chelating functionality, can be a metal selective adsorption agent within the scope of the methods described herein provided it has an appropriate adsorptivity and selectivity.

A metal selective adsorption agent as used herein is an agent that effectively removes soluble metals from a concentrated aqueous tobacco extract and to a greater extent than it adsorbs other constituents, i.e., organic compounds such as alkaloids. A measure of the effectiveness of a material at removing soluble metal from aqueous tobacco extract can by determined by a straightforward measurement of the reduction of soluble metal using a standardized amount of adsorbent under standardized conditions. For example, the concentration of soluble metal can be determined in a sample of untreated concentrated aqueous tobacco extract using any recognized quantitative procedure. A sample (35 ml) of concentrated extract is allowed to come to equilibrium at a temperature that is consistent with processing of tobacco extract, such as about 110° F. to 140° F., in the presence of adsorption agent (1 g) under conditions of constant stirring or agitation that is sufficient to keep the adsorbent in suspension such as by placing the material in a vial on a rotary plate. The concentration of total soluble metal in treated and untreated extract is compared. For convenience, an adsorptivity index from 0 to 100 can be defined by taking the percentage of a soluble metal removed from 35 ml of concentrated aqueous tobacco extract by 1 g of agent at 110° F. A soluble metal selective adsorption agent for use in the present methods will preferably have an adsorptivity index greater than about 60. Soluble metal selective adsorption agents with adsorptivity indices of greater than about 70 are preferred, agents with indices of about 75 or greater are most preferred.

Selectivity can be described by an index that can be determined by a straightforward test. Agents that are selective between metals (i.e., metal cations) and organic compounds are preferred as opposed to agents that are selective between various metal ions. Thus selectivity between a metal and an organic constituent of tobacco extract is a useful criteria for a metal selective adsorption agent. For example, a cadmium selectivity index can be defined for a metal selective adsorption agent as follows: The level of cadmium and the level of alkaloid compounds is determined in a sample of concentrated aqueous tobacco extract. An amount of concentrated aqueous tobacco extract (35 ml) is contacted with an amount of the agent (1 g) at a temperature that is compatible with the processing of such extract (e.g., about 110° F. to 140° F.) with constant agitation (i.e., stirring or gentle shaking which does not introduce bubbles into the extract or produce foam). The mixture is allowed to come to equilibrium. The agent is separated from the concentrated aqueous tobacco extract and the level of cadmium and the level of alkaloid compounds is again determined in the concentrated aqueous tobacco extract. The metal selectivity index is defined by the percentage reduction in the level of cadmium in 35 ml of concentrated aqueous tobacco extract by 1 g of agent at 110° F. divided by the percent reduction in alkaloids. As an illustration, an agent that reduces the level of cadmium by 75% and the level of alkaloids by 5% has a cadmium selectivity index of 15. A cadmium selective adsorption agent according to the usage described herein has a cadmium selectivity index of greater than 15 and more preferably greater than about 20 (e.g., greater than 30, 40, 50, 60 or 70±5). As set forth below, various conditions can influence the selectivity of an agent. In considering these factors, it will be understood that the most favorable conditions that are compatible with the processing of tobacco extract for the preparation of smoking materials should be individually determined in applying methods described herein.

In accordance with this discovery, a method of selectively removing metals, such as cadmium, nickel, mercury, and lead, from an aqueous extract of tobacco comprises contacting the aqueous extract with a metal selective adsorption agent. A metal selective adsorption agent can be a macroporous crosslinked metal binding polymer resin. Preferred macroporous resins are those that have been formed as copolymers and then post-crosslinked in a swollen state. Such a polymer preferably comprises chelating functional groups, such as iminodiacetic acid groups. In a preferred example of the method, the method comprises contacting the aqueous extract with an iminodiacetic acid functionalized styrene-divinylbezene resin.

The relative affinity of styrene divinylbenze copolymer resin having iminodiacetate functional chelating groups for particular divalent cations can be affected by counterions, the ionic strength of the extract, and the pH of the liquid extract. Thus, selectivity for $Hg^{2+}$ can be increased in the presence of nitrate. In the presence of chloride ions $Hg^{2+}$ can be removed with a lesser degree of specificity and other ions can be removed with higher relative affinity.

As another example, the relative affinity of such polymer resins for $Hg^{2+}$ versus $Cd^{2+}$ can be greater at about pH 4 while the relative affinity for $Cd^{2+}$ can be increased at higher pH (such as around pH 9) and where the ionic strength of the aqueous extract is greater (such as in a solution of 1.5 M ionic strength).

Thus, the aqueous extract may be adjusted for selective removal of specific soluble metal ions by adjusting the pH of the tobacco extract, by increasing or decreasing the ionic strength or presence of certain counter ions (such as $NO_3$). Such adjustments may be accomplished economically as a part of a complete processing method, by arranging the processing steps (i.e., concentration, dilution, removal of nitrates, and the like) so as to maximize selectivity in accordance with the desired removal of selected constituents. For example, the ionic strength of an extract can be adjusted by concentration or dilution of the tobacco extract. Further, processing steps accomplishing the removal of non-metallic ions such as nitrates may be performed before and/or after a step comprising contacting the extract with a macroporous polymer comprising chelating functional groups.

As another example, the pH of the aqueous tobacco extracted may be adjusted to below about pH 7, for example to about pH 5 or about pH 4 prior to contacting the extract with a chelating resin. The pH can be adjusted by adding acidic or basic compounds including strong or weak acids and bases and buffering compounds. However, at very low pH, such as about pH 2, the resin can fail to bind metal ions. Therefore, the pH during contacting with a chelating resin is preferably above the pKa of the acidic chelating functional groups. Alternatively, for example, the pH of the aqueous tobacco extracted may be adjusted to above about pH 7, for example to about pH 9 or about pH 12 prior to contacting the extract with a chelating resin.

In an elaboration of the method, an apparatus can be arranged for contacting the tobacco extract with chelating resin two or more separate times with the extract adjusted to increase the selective removal of one or more metal ions between each contact with chelating resin.

Selective Removal of Nitrate from Aqueous Tobacco Extract

Typically, nitrate is removed from tobacco extracts by crystallization. However, this requires a separate step of processing and attendant equipment operation and maintenance costs. A method of selectively reducing the amount of nitrate from an aqueous tobacco extract comprising contacting the extract with a nitrate selective adsorption agent can be performed without crystallization. Further the method can be performed separately or in combination with the selective removal of one or more other constituents of tobacco extract. Preferred properties of nitrate selective adsorption agents for use in processing aqueous tobacco extracts have been identified.

Preferred nitrate selective adsorption agents include anionic styrene-divinyl benzene copolymer or acrylic-divinyl benzene as a gel or macroreticular resin, preferably functionalized by a strong base or a weak base moiety. A preferred nitrate selective adsorption agent can comprise tertiary or quaternary amine or quaternary ammonium functional groups.

Preferred examples of a resin having preferred properties of a nitrate selective adsorption agent include Dowex™ Marathon™ WBA-2, Dowex™ Marathon™ A and MTO-Dowex™ M43 manufactured by the Dow Chemical Corporation, and Rohm and Haas Amberlite™ FPA51, FPA53 and FPA90Cl. It should be noted that nitrate selective adsorption agents are not limited to the exemplified materials. Preferred properties of a nitrate selective adsorption agent can be determined by examination of these exemplary nitrate selective adsorption agents. Furthermore, a nitrate selective adsorption agent can be manufactured comprising features that vary from the foregoing examples, so long as the agent has the adsorption and selectivity of a nitrate selective adsorption agent.

A preferred nitrate selective adsorption agent, exemplified by Rohm and Haas Amberlite™ FPA51, which comprises a macroreticulated styrene-divinyl benzene resin with a weak base functionality can have a solid density of about 1.06 $g/cm^3$, a bulk density of about 0.32 $g/cm^3$, and a particle density of about 0.47 $g/cm^3$. Such a resin can preferably have a void fraction of about 0.70, with a bulk void fraction of about 0.31 and a particle void fraction of about 0.56. The particle specific pore volume of such a resin can preferably be about 1.18 $cm^3/g$. The particle size is preferably such that the Sauter average diameter can be about 0.34 mm while the number average diameter can be about 0.29 mm.

A preferred nitrate selective adsorption agent, exemplified by Rohm and Haas Amberlite™ FPA53, which comprises an acrylic-divinyl benzene gel with a weak base functionality can have a solid density of about 1.15 $g/cm^3$, a bulk density of about 0.63 $g/cm^3$, and a particle density of about 0.97 $g/cm^3$. Such a resin can preferably have a void fraction of about 0.45, with a bulk void fraction of about 0.35 and a particle void fraction of about 0.16. The particle specific pore volume of such a resin can preferably be about 0.16 $cm^3/g$. The particle size is preferably such that the Sauter average diameter can be about 0.49 mm while the number average diameter can be about 0.45 mm.

A preferred nitrate selective adsorption agent, exemplified by Rohm and Haas Amberlite™ FPA90Cl, which comprises styrene-divinyl benzene resin macroreticulated resin with a strong base quaternary ammonium functionality can have a solid density of about 1.26 $g/cm^3$, a bulk density of about 0.46 $g/cm^3$, and a particle density of about 0.60 $g/cm^3$. Such a resin can preferably have a void fraction of about 0.63, with a bulk void fraction of about 0.23 and a particle void fraction of about 0.53. The particle specific pore volume of such a resin can preferably be about 0.88 $cm^3/g$. The particle size is preferably such that the Sauter average diameter can be about 0.42 mm while the number average diameter can be about 0.36 mm.

A preferred nitrate selective adsorption agent, exemplified by Dowex™ Marathon WBA-2, comprises a styrene-divinyl benzene resin macroreticulated resin with a weak base tertiary amine functionality can have a solid density of about 1.11 $g/cm^3$, a bulk density of about 0.42 $g/cm^3$, and a particle density of about 0.61 $g/cm^3$. Such a resin can preferably have a void fraction of about 0.63, with a bulk void fraction of about 0.32 and a particle void fraction of about 0.45. The particle specific pore volume of such a resin can preferably be about 0.73 $cm^3/g$. The particle size is preferably such that the Sauter average diameter can be about 0.53 mm while the number average diameter can be about 0.50 mm.

A preferred nitrate selective adsorption agent, exemplified by Dowex™ Marathon™A, comprises a styrene-divinyl benzene resin macroreticulated resin with a strong base quaternary amine functionality can have a solid density of about 1.26 $g/cm^3$, a bulk density of about 0.65 $g/cm^3$, and a particle density of about 0.96 $g/cm^3$. Such a resin can preferably have a void fraction of about 0.48, with a bulk void fraction of about 0.32 and a particle void fraction of about 0.24. The particle specific pore volume of such a resin can preferably be about 0.25 $cm^3/g$. The particle size is preferably such that the Sauter average diameter can be about 0.35 mm while the number average diameter can be about 0.33 mm.

A preferred nitrate selective adsorption agent, exemplified by Dowex™ M43, which comprises styrene-divinyl benzene resin macroreticulated resin with a weak base functionality of greater than about 1.55 eq/liter can have a solid density of about 1.13 $g/cm^3$, a bulk density of about 0.43 $g/cm^3$, and a particle density of about 0.61 $g/cm^3$. Such a resin can preferably have a void fraction of about 0.62, with a bulk void fraction of about 0.30 and a particle void fraction of about 0.46. The particle specific pore volume of such a resin can preferably be about 0.75 $cm^3/g$. The particle size is preferably such that the Sauter average diameter can be about 0.52 mm while the number average diameter can be about 0.46 mm.

Preferably, nitrate selective adsorption agents have a substantial capacity for nitrate adsorption, for example loading greater than about 0.35 mmol, preferably greater than about 0.37 mmol, more preferably greater than about 0.38 mmol or 0.42 mmol nitrate per gram adsorbent in an extract having about 0.6% (i.e., 0.12 mmol/ml) nitrate extract and are capable of coming to equilibrium in contact with tobacco extract in less than about 6 hours, more preferably less than about 4 hours, and most preferably in about 2 hours or less.

A nitrate selective adsorption agent is defined as an agent that effectively removes nitrate compounds from a tobacco extract, and removes nitrate compounds to a greater extent than it removes other compounds. For example, a nitrate selective adsorption agent preferably extracts nitrate to a greater extent than other organic components present in aqueous tobacco extract. Exemplary compounds against which selectivity in tobacco extract can be measured are alkaloids, reducing sugars, and soluble ammonia.

A measure of the effectiveness of an agent at removing nitrate from aqueous tobacco extract can by determined by a straightforward measurement of the reduction of nitrate compounds using a standardized amount of adsorbent under standardized conditions. For example, the concentration of nitrate compounds and other compounds can be determined in a sample of untreated concentrated aqueous tobacco extract using any recognized quantitative procedure. A sample (35 ml) of concentrated extract, such as having a density of about 1.28 g/ml, is allowed to come to equilibrium at a temperature that is consistent with the processing of tobacco extract, such as 110° F. to 140° F., in the presence of 3 g of adsorbent material under conditions of constant stirring or agitation sufficient to keep the adsorbent in suspension such as by placing the extract and adsorbent material in a vial on a rotary plate. The concentration of total nitrate compounds is compared for treated and untreated extract. An adsorptivity index on a scale of 0 to 100 can be defined by taking the percentage of total nitrate compounds removed from 35 ml of concentrated aqueous tobacco extract by 3 g of agent at 110° F. A nitrate selective adsorption agent for use in the present methods will preferably have an adsorptivity index at least about 12 or 16 and preferably greater than about 23. Nitrate selective adsorption agents with adsorptivity indices of greater than about 37 are more preferred, and agents with indices of greater than about 44 or 51 or greater are most preferred.

A selectivity index for nitrate selective agents can be defined using a procedure as follows. The level of total nitrate compounds and the level of alkaloid compounds is determined in a sample of concentrated aqueous tobacco extract. An amount of concentrated aqueous tobacco extract (35 ml) is contacted with an amount of the agent (3 g) at a temperature that is usually maintained during the processing of such extract (for example, about 110° F.) with constant agitation. The mixture is allowed to come to equilibrium. The agent is separated from the concentrated aqueous tobacco extract, and the level of nitrate compounds and the level of alkaloid compounds is determined again in the concentrated aqueous tobacco extract. The percentage reduction in the level of all nitrate compounds is divided by the percent reduction in alkaloids. As an illustration, an agent that reduces the concentration of nitrate by 42% and the concentration of alkaloids by 4.1% has a nitrate selectivity index of greater than 10. A nitrate selective adsorption agent according to the usage herein preferably has a nitrate selectivity index of at least 3.8, and preferably greater than about 4, more preferably greater than about 12 and most preferably at least about 45 or greater.

Preferred Methods of Contacting a Selective Adsorption Agent with Concentrated Tobacco Extract The aqueous extract can be contacted with the adsorption agent by passing the extract through polymer resin beads contained in a vessel, such as a cylindrical column, or in a plurality of vessels connected in parallel with the latter arrangement being preferred. In a preferred arrangement, at least two columns connected in parallel are on-line at any time with an approximately equal number of columns being off-line for regeneration, for example by hot water, steam and/or solvent wash. For example, extract can be passed through a bed of an iminodiacetic acid functionalized styrene-divinylbezene resin in a plurality of columns connected in parallel for a period sufficient to substantially reduce the amount of metal ions in the extract. The contacting period is adjustable by controlling the flow-rate of the extract and depth of the bed of resin beads in the column. Flow rates for use in the methods described herein may be adjusted to control the contact time according to the binding kinetics. Preferably, a flow rate is set according to the rate constant of binding for the agent and the void volume of the bed, so that approximately one void volume is passed through the agent in a time equivalent to the rate constant.

Where the tobacco extract is a concentrated aqueous tobacco extract, it can be surprisingly difficult to perform the contacting step by passing the extract through a column of adsorption agents. For example, gelation of the aqueous tobacco extract in a column of adsorption agent can produce a pressure drop that overwhelms system pumps or results in channeling through the adsorption agent bed. Thus, it can be advantageous to utilize an alternative arrangement in the contacting step. Moreover, it has been determined that as a consequence of the adsorption rate properties of selective adsorption agents, it can be possible to utilize a greater portion of the adsorption capacity of an agent by use of a preferred method as described below.

Accordingly, aqueous tobacco extract can be contacted with one or more selective adsorption agents in one or more batch process steps in which extract and agent(s) are contacted in a vessel such that the agent does not form a bed during the contacting step. For example, agent and extract can be contacted in a vessel and subjected to stirring or agitation sufficient to keep the agent suspended but preferably not so vigorous as to cause foaming. Agent(s) and extract can be separated thereafter by any appropriate method such as filtration or decanting the extract after allowing the agent to settle. Settling of the agent can be accelerated by centrifugation.

Alternatively, a counter-current arrangement can be utilized in the contacting step. In such an arrangement, aqueous tobacco extract and selective adsorption agent are introduced from opposing portions of a vessel. For example, aqueous tobacco extract can be introduced to an upper portion of a vessel while selective adsorption agent can be continuously introduced in a lower portion of the vessel such that the flow rate of the agent achieves plug flow through the extract and is collected from at or near the top of the vessel and extract is collected from at or near the bottom of the vessel. Alternatively, aqueous tobacco extract can be introduced to a lower portion of a vessel while a selective adsorption agent can be introduced in an upper portion of the vessel and the upflow rate of the aqueous tobacco extract can be maintained such that the selective adsorption agent passes downwardly through the extract so that agent can be collected from the bottom portion of the vessel while extract is collected from the top portion of the vessel.

It can be advantageous to combine more than one selective adsorption agent into a contacting vessel so that, for example, the contacting step of a method to remove TSNAs from aqueous tobacco extract and the contacting step of a method to remove metal ions from the extract can be simultaneously carried out. This can be accomplished using either a column or batch process. Thus, a method of selectively reducing metals and TSNAs in an aqueous tobacco extract can comprise a step of contacting the extract with a metal selective adsorption agent and a TSNA selective adsorption agent. The ratio of the agents can be approximately equivalent, i.e., a 1:1 ratio of TSNA selective agent and metal selective agent. For example, a preferred combination of TSNA selective agent and soluble metal selective agent is an approximately 1:1 mixture, by dry weight, of Dow Optipore L493 and Rohm and Haas IRC-748, or comparable agents having preferred physical characteristics of these resins. Alternatively, in an elaboration of the method, the ratio of agents can be chosen to match the relative capacities and/or kinetics of the agents. The ratios can also be advantageously chosen to match the relative capacity of an agent in a given period with the relative concentration of constituent that is selectively removed by that agent.

It can also be advantageous to simultaneously use a plurality of contacting vessels, which can be substantially similar and connected to the processing stream in parallel. In the use of such a system, it can also be advantageous to maintain a number of out-of-service vessels, approximately equal to the in-service vessels, in a standby or regenerating mode.

Modified Column Apparatus for Removal of Selected Constituents of Concentrated Aqueous Tobacco Extract When it is desired to use a column arrangement in the contacting step, the methods are preferably performed using an apparatus that has been adapted for the purpose. As described above, the tobacco extract can be advantageously concentrated prior to contacting the extract with the selective adsorbent agents. When the adsorption agent is in the form of a bed of resin beads and the contacting vessel is in the form of a column, it is also advantageous to maximize the duration of the in-service period of a resin bead column. However, an obstacle to simultaneously achieving these goals has been discovered to be the tendency of concentrated tobacco extract to form a gel in a resin bead bed. This results in a rapid increase in the pressure drop across the column, thus shortening the workable in-service period of a column. To increase the duration of in-service period of a resin bead column and to overcome the problems associated with increasing pressure drop, modifications to the usual design of a resin bead bed column can be made.

Columns for contacting liquids with adsorbent resins commonly have relative dimensions of about 5:1 length:diameter, or greater, where the length is understood as the distance between the inlet and the outlet and the width is the average dimension in an orthogonal direction. Flowing concentrated tobacco extract through columns of such relatively long dimensions can result in greater gelation of the extract and a shortening of the in-service period of a column. When applied in the present methods, this effect can be reduced by using a column with dimensions of less than about 2:1 length:diameter, such as about 1:1 or preferably about 0.6 to 0.75:1 length:diameter. In practice, the scale and number of parallel columns will be determined by the skilled practitioner according to the desired capacity.

Furthermore, including one or more pressure plates spaced along the length of the column can distribute the overall pressure drop more evenly through the column. These pressure plates are discs, preferably thin and yet relatively rigid, approximately equal in diameter to the interior diameter of the column, and perforated with one or more holes through which extract can flow. The plates can be made of any suitable material such as ceramic, plastic, polycarbonate, and metals such as stainless steel. The pressure plates are perforated by one or more evenly distributed holes or passages. One or more mesh screens can also be used. The plates can be held in place in the column by attaching the plates to the sides of the columns or by otherwise restraining the plates from moving along the length of the column.

Where the contacting steps of the methods are combined, the plates can be placed between beds of differing adsorption agents in a vessel. However, it is not necessary to separate the agents. For example, a mixed bed may be made and used comprising a plurality of intermixed selective adsorption agents. In this way, a single homogenously mixed bed can be used to accomplish selective removal of a plurality of constituents of the aqueous tobacco extract.

An apparatus adapted to the methods described herein can comprise one or more selective agent contacting vessels. In a preferred arrangement, a contacting step is conducted in a selective agent contacting vessel while agent in another vessel is being regenerated. Vessels or pairs of vessels can be connected in parallel. For example, a portion of a tobacco extract processing apparatus adapted to performing a method described above may comprise four selective agent contacting vessels connected in parallel, wherein two vessels are in service at a time and in two vessels the agent is being regenerated by flowing solvent such as steam through the vessel.

While various methods and devices have been described in detail with reference to examples and preferred embodiments thereof, it will be apparent to one skilled in the art that various changes can be made, and equivalents employed, without departing from the scope of what is described herein. The following additional examples are provided for illustration of the principles described herein and should not be construed as limiting the methods and devices described herein in any way.

EXAMPLES

Example 1

Identifying TSNA and Metal Selective Adsorption Agents

The following materials were tested for adsorption of constituents of concentrated tobacco extract:

| Adsorbent Composition | Form | Trade Name |
|---|---|---|
| Activated Alumina | Granular | Alcoa DD2 |
| Activated Carbon | Granular | Calgon CPG LF |
| Activated Carbon | Pellet | Norit RO 0.8 |
| Silica Gel | Granular | Davison 408 |
| Y-type Zeolite | Pellet | UOP Hysiv-1000 |
| ZSM Zeolite | Pellet | UOP Hysiv-3000 |
| Polymeric Resin (Anionic) | Bead | R&H Amberlite ™ IRA-400CL |
| Polymeric Resin (Chelating) | Bead | R&H Amberlite ™ IRC-748 |
| Acrylic Resin | Bead | R&H Amberlite ™ XAD-7 |
| Styrene - DVB Resin | Bead | Dowex ™ Optipore ™ L 493 |

Vials of concentrated tobacco extract (35 ml) with 0, 0.03, 0.1, 0.3, and 1 g of each adsorbent material were allowed to equilibrate for 24 hours at 140° F. under gentle agitation on a rotary platform. The concentration of NAB, NAT, NNK, and NNN, comprising total TSNA, as well as alkaloids, reducing sugars, soluble ammonia, Ni, As, Se, Cd and Pb was determined.

Adsorption effectiveness of the adsorbent materials for TSNA compounds is shown in TABLE 2. Dowex™ Optipore™ L493 was most effective in selectively removing total TSNA from the concentrated tobacco extract. Water may be displaced from adsorption agents when other compounds are adsorbed. No attempt to account for this possible effect has been made for the purposes of the comparative measurements reported herein.

TABLE 2

| | Reduction | | | | | | TSNA |
|---|---|---|---|---|---|---|---|
| Material | NAB | NAT | NNK | NNN | Total TSNA | Alkaloids | Selectivity |
| Calgon CPG LF | 65.02 | 69.84 | 83.04 | 47.45 | 60.66 | 11.97 | 5.0 |
| Dow Optipore L493 | 93.21 | 93.71 | 90.37 | 81.14 | 86.41 | 8.55 | 10.1 |
| Norit RO 0.8 | 71.87 | 76.85 | 83.55 | 59.71 | 69.12 | 13.68 | 5.1 |
| Rohm & Haas XAD7 | 69.00 | 68.94 | 55.84 | 39.15 | 50.60 | 3.31 | 15.3 |
| UOP HISIV 1000 | 72.62 | 72.13 | 41.16 | 40.44 | 48.96 | 14.05 | 3.5 |

Adsorption capability and selectivity of materials for soluble metals is shown in TABLE 3. Rohm and Haas IRC-748 was most effective and selective in removing total Cd from the concentrated tobacco extract

TABLE 3

| | % Reduction | | | | | |
|---|---|---|---|---|---|---|
| Material | As | Cd | Pb | Alkaloids | Reducing Sugars | Cd Selectivity |
| Dow Optipore 493 | 11.73 | 7.99 | 77.52 | 8.55 | 0.00 | 0.9 |
| Norit RO 0.8 | NA | 16.04 | 34.47 | 13.68 | 2.04 | 1.2 |
| Rohm & Haas XAD-7 | 18.32 | 5.64 | 67.05 | 3.31 | 0.00 | 1.7 |
| Rohm & Haas IRC-748 | 14.04 | 78.91 | 33.16 | 3.31 | 0.00 | 23.9 |
| Alcoa DD2 14 × 28 | 42.54 | 4.74 | 46.95 | 0.00 | 2.04 | NA |
| Rohm & Haas IRA-400CL | 11.94 | 33.46 | 0.30 | 1.65 | 0.00 | 20.2 |

A combination of 0.5 g Dow Optipore L493 and Rohm and Haas IRC-748 was tested for combined adsorption and selectivity of TSNA and Cd. Results are shown in TABLE 4.

TABLE 4

| 1:1 Mixture Dow Optipore 493 and Rohm & Haas IRC-748 | | | | | | |
|---|---|---|---|---|---|---|
| % Reduction | | | | | | |
| Reducing | | | | Total | Selectivity | |
| Alkaloids | Sugars | Cadmium | Lead | TSNA | TSNA | Cd |
| 6.03 | 1.59 | 58.71 | 22.41 | 73.05 | 12.10 | 9.72 |

Example 2

Identifying Nitrate Selective Adsorption Agents

Materials were tested for adsorption of nitrate and other constituents of concentrated tobacco extract. Vials of concentrated tobacco extract (about 35 ml) with 0, 0.1, 0.3, 1 and 3 g of dry adsorbent material were allowed to equilibrate for 1 to 24 hours at 110° F. under gentle agitation on a rotary platform. The concentration of nitrate, as well as alkaloids, reducing sugars, and soluble ammonia was determined.

Adsorption capacity and selectivity of the 3 g adsorbent materials for nitrate and selectivity against alkaloids are shown in TABLE 5. (Where observed reduction was less than the margin of error ~0 is indicated. For purposes of calculating selectivity, this is taken as 1%).

TABLE 5

| | % Reduction | | Nitrate |
|---|---|---|---|
| | Alkaloids | Nitrate | Selectivity |
| MTO-Dowex ™ M43 | 6.0 | 27.1 | 4.5 |
| Amberlite ™ FPA51 | 7.2 | 50 | 7 |
| Marathon ™ A | 12.4 | 46.9 | 3.8 |
| Marathon ™ MSA | 3.1 | 59.5 | 19.2 |
| Marathon ™ WBA-2 | ~0 | 55.9 | 56 |
| Amberlite ™ FPA40Cl | 11.1 | 18.8 | 1.7 |
| Amberlite ™ FP53 | 8.5 | 56.9 | 6.7 |
| Amberlite ™ FPA90Cl | 9.3 | 44.0 | 4.7 |

All of the above-mentioned references are herein incorporated by reference in their entirety to the same extent as if each individual reference was specifically and individually indicated to be incorporated herein by reference in its entirety.

What is claimed is:

1. A method of selectively removing tobacco specific nitrosamines (TSNAs) from an aqueous tobacco extract comprising the steps of:

preparing an aqueous tobacco extract; and contacting the extract with a TSNA selective adsorption agent comprising a copolymer of styrene and divinyl benzene, wherein the TSNA selective adsorption agent comprises resin beads and has a TSNA selectivity index of at least about 8, wherein the copolymer of styrene and divinyl benzene contains a chelating moiety, wherein the chelating moiety is an oxygen or nitrogen-containing group.

2. The method of claim 1 further comprising the steps of concentrating the aqueous tobacco extract before contacting the extract with a TSNA selective adsorption agent.

3. The method of claim 1 wherein the TSNA selective adsorption agent has an average pore size of less than 100 Å and an internal surface area of from about 300 to about 1100 $m^2/g$.

4. The method of claim 1 wherein the TSNA selective adsorption agent has an internal surface area of at least about 1000 $m^2/g$ and a total porosity of about 1.15 ($cm^3/g$) or greater.

5. The method of claim 1 wherein the TSNA selective adsorption agent is said copolymer of styrene and divinyl benzene and is post-cross linked in a swollen state with a crush strength of greater than about 500 (g/bead).

6. The method of claim 1 wherein the TSNA selective adsorption agent has a TSNA adsorptivity index of at least 50.

7. The method of claim 1 wherein the TSNA selective adsorption agent has a TSNA adsorptivity index of about 70 or greater.

8. The method of claim 1 wherein the TSNA selective adsorption agent has a TSNA adsorptivity index of about 80 or greater and a TSNA selectivity index of at least about 10.

9. The method of claim 1 wherein the TSNA selective adsorption agent has a TSNA adsorptivity index of about 50 or greater and a TSNA selectivity index of greater than about 10.

10. The method of claim 1 wherein the extract and the TSNA selective adsorption agent are contacted using a counter-current arrangement.

11. The method of claim 1 wherein the extract and the TSNA selective adsorption agent are contacted in a contacting vessel having a ratio of length to diameter of less than about 2 to 1.

12. The method of claim 1 wherein the TSNA selective adsorption agent has a TSNA selectivity index of at least 15.3.

13. The method of claim 1, wherein the chelating moiety is an iminodiacetic acid group, a nitrilotriacetic acid group or an ethylenediamine tetra-acetic acid group.

14. The method of claim 1, wherein the TSNA selective adsorption agent has a cadmium adsorptivity index of at least about 60 or a cadmium selectivity index of at least 15.

15. The method of claim 1, wherein the TSNA selective adsorption agent has a cadmium adsorptivity index of at least about 75 or a cadmium selectivity index of at least 20.

16. A method of selectively removing tobacco specific nitrosamines (TSNAs) from an aqueous tobacco extract comprising:

preparing an aqueous tobacco extract; and contacting the extract with a TSNA selective adsorption agent comprising a macrorecticular copolymer of styrene and divinyl benzene, wherein the TSNA selective comprises resin beads having a crush strength of greater than about 500 g/bead and a particle size from about 20-50 mesh, and has a TSNA selectivity index of at least about 8, wherein the copolymer of styrene and divinyl benzene comprises an anionic copolymer of styrene and divinyl benzene, or a copolymer of styrene and divinyl benzene containing a chelating moiety, wherein the chelating moiety is an oxygen or nitrogen-containing group.

17. The method of claim 16 wherein the copolymer of styrene and divinyl benzene comprises a macroreticular copolymer of styrene and divinyl benzene.

18. The method of claim 16 wherein the copolymer of styrene and divinyl benzene comprises the anionic copolymer of styrene and divinyl benzene.

19. The method of claim 18 wherein the anionic copolymer of styrene and divinyl benzene contains a tertiary or quaternary amine or quaternary ammonium functional group.

20. The method of claim 16, wherein the chelating moiety is an iminodiacetic acid group, a nitrilotriacetic acid group or an ethylenediamine tetra-acetic acid group.

21. A method of selectively removing tobacco specific nitrosamines (TSNAs) from an aqueous tobacco extract comprising the steps of:

preparing an aqueous tobacco extract; and contacting the extract with a TSNA selective adsorption agent comprising an acrylic resin and/or a macroreticular copolymer of styrene and divinyl benzene, wherein the TSNA selective adsorption agent comprises resin beads and has a TSNA selectivity index of at least about 8, wherein the macroreticular copolymer of styrene and divinyl benzene comprises an anionic copolymer of styrene and divinyl benzene, or a copolymer of styrene and divinyl benzene containing a chelating moiety, wherein the chelating moiety is an oxygen or nitrogen-containing group.

22. The method of claim 21, wherein the chelating moiety is an iminodiacetic acid group, a nitrilotriacetic acid group or an ethylenediamine tetra-acetic acid group.

23. A method of selectively removing tobacco specific nitrosamines (TSNAs) from an aqueous tobacco extract comprising the steps of:

preparing an aqueous tobacco extract; and contacting the extract with a TSNA selective adsorption agent comprising an anionic copolymer of styrene and divinyl benzene, wherein the TSNA selective adsorption agent comprises resin beads and has a TSNA selectivity index of at least about 8.

24. The method of claim 23 wherein the anionic copolymer of styrene and divinyl benzene contains a tertiary or quaternary amine or quaternary ammonium functional group.

* * * * *